US012359671B2

(12) United States Patent
Cangioli et al.

(10) Patent No.: US 12,359,671 B2
(45) Date of Patent: Jul. 15, 2025

(54) HYDROGEN COMPRESSING ASSEMBLY, HYDROGEN PRODUCTION PLANT, AND COMPRESSING METHOD

(71) Applicant: NUOVO PIGNONE TECNOLOGIE-SRL, Florence (IT)

(72) Inventors: Francesco Cangioli, Florence (IT); Domenico Berterame, Florence (IT); Angelo Grimaldi, Florence (IT); Alberto Guglielmo, Florence (IT)

(73) Assignee: Nuovo Pignone Tecnologie—S.R.L., Florence (IT)

( * ) Notice: Subject to any disclaimer, the term of this patent is extended or adjusted under 35 U.S.C. 154(b) by 0 days.

(21) Appl. No.: 18/556,594

(22) PCT Filed: Apr. 21, 2022

(86) PCT No.: PCT/EP2022/025168
§ 371 (c)(1),
(2) Date: Oct. 20, 2023

(87) PCT Pub. No.: WO2022/228720
PCT Pub. Date: Nov. 3, 2022

(65) Prior Publication Data

US 2024/0209866 A1 Jun. 27, 2024

(30) Foreign Application Priority Data

Apr. 26, 2021 (IT) ..... 102021000010475

(51) Int. Cl.
*F04D 25/16* (2006.01)
*F04D 25/06* (2006.01)

(52) U.S. Cl.
CPC ..... *F04D 25/163* (2013.01); *F04D 25/068* (2013.01)

(58) Field of Classification Search
CPC .... F04D 17/12; F04D 25/163; F04D 29/5826; F04D 23/001
See application file for complete search history.

(56) References Cited

U.S. PATENT DOCUMENTS

2011/0305558 A1 12/2011 Omori
2012/0011857 A1* 1/2012 Becker ..... F02C 7/12 700/282
2013/0058761 A1 3/2013 Nass
2013/0125743 A1 5/2013 Adler
2016/0040927 A1* 2/2016 Pelagotti ..... F04D 25/163 62/613

FOREIGN PATENT DOCUMENTS

EP 2980413 A1 2/2016
JP 2000303990 A 10/2000
JP 2003293987 A 10/2003
JP 2012241719 A 12/2012
(Continued)

*Primary Examiner* — David E Sosnowski
*Assistant Examiner* — Jackson N Gillenwaters
(74) *Attorney, Agent, or Firm* — Paul Frank + Collins P.C.

(57) ABSTRACT

A hydrogen production plant, to produce hydrogen having a compressing assembly, for increasing the pressure of the hydrogen. The compressing assembly has at least one barrel compressor and at least one integrally geared centrifugal compressor. Also disclosed are methods of compressing hydrogen.

8 Claims, 4 Drawing Sheets

(56) References Cited

FOREIGN PATENT DOCUMENTS

| | | | | |
|---|---|---|---|---|
| KR | 20180096998 | | * | 8/2018 |
| KR | 20180096998 | A | | 8/2018 |
| WO | 2010095507 | A1 | | 8/2010 |
| WO | 2013/022682 | A1 | | 2/2013 |
| WO | 2014/161937 | A2 | | 10/2014 |

* cited by examiner

HYDROGEN COMPRESSING ASSEMBLY, HYDROGEN PRODUCTION PLANT, AND COMPRESSING METHOD

TECHNICAL FIELD

The present disclosure concerns a hydrogen compression assembly and a plant for producing high-pressure hydrogen including the hydrogen compression assembly, which can be used in several industrial processes, such as for producing ammonia, or as fuel source for turbines and engines, such as gas turbine of different kind, which can be used in different technical areas.

In the following the description will refer to the compression of hydrogen, but it is clear that the same should not be considered limited to this specific use since the compressing assembly can be used also to compress any other kind of gas.

BACKGROUND ART

Hydrogen is produced for several industrial applications. For instance, one of the most important industrial applications of hydrogen (not the sole one) is the production of ammonia, which is a well-known chemical product usually used scopes and in a variety of industrial fields. For instance, ammonia is produced to be used as a fertilizer for fields in different types of crops. In addition, ammonia is also largely used in the crude oil refining sector, especially as a carrier for hydrogen, namely for the transport of the same.

Currently, hydrogen is mainly produced with the so-called steam-reforming process. According to this production process, methane is initially compressed. As is well known, methane is a gas that can be easily compressed, since its molecular weight is quite high (about 18). Subsequently, a step of separation of hydrogen from carbon (the so-called reforming step) takes place, obtaining hydrogen ($H_2$) at a pressure of 30 bars-40 bars, which is then mixed with nitrogen in order to obtain ammonia. At the pressure of 30 bars-40 bars, hydrogen can be easily transported in storage containers and/or via short and long-distance pipelines.

As is well known, hydrogen is a very small and light molecule. Therefore, transporting hydrogen through pipelines is troublesome. Generally, to achieve efficient transportation of this gas, it is necessary that it is at a pressure of the order mentioned above of 30 bar-40 bar.

The hydrogen production technology mentioned above, although effective, has several technical problems. One of the main problems is that it is not environment-friendly. In fact, the methane must be burnt, with the consequent production of carbon dioxide ($CO_2$), thus obtaining the so-called "gray hydrogen". The recent industrial interest to produce "green hydrogen", i.e., obtained by avoiding burning methane and diffusing carbon dioxide in the atmosphere, is rapidly growing in the market.

In addition, the plants for burning and treating methane have traditionally a very high footprint as well as operational costs.

Accordingly, an improved compressing assembly and a method of compressing hydrogen, and in general any other gas, would be welcomed in the field. More in general, it would also be desirable to provide a new type of plant capable of producing green hydrogen without burning methane or any other fuel.

SUMMARY

In one aspect, the subject matter disclosed herein is directed to a novel and industrially useful hydrogen compressing assembly and a hydrogen production plant configured to produce hydrogen by electrolysis, The compressing assembly is apt to increase the pressure of the hydrogen or any other gas. The compressing assembly comprises at least one compression unit having barrel compressors, and at least one compression unit of integrally geared centrifugal compressor type.

In another aspect, the subject matter disclosed herein concerns compression unit having two barrel compressors, with relevant gearboxes, and a drive electric motor connected to the first and the second gearboxes, to operate the barrel compressors.

In another aspect, disclosed herein is a compressing unit having a variable or fixed speed electric motor.

In another aspect, disclosed herein is a compression unit having a bull gear, a plurality of impellers, mechanically driven by the bull gear, and an electric drive electric motor operatively connected to the bull gear, to operate the impellers.

A further aspect of the present disclosure is drawn to a method of compressing hydrogen gas comprising the steps of obtaining hydrogen gas, compressing the hydrogen by at least one centrifugal compressor, and then compressing the hydrogen by at least one of an integrally geared centrifugal compressor.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS

Hydrogen is used in many industrial applications, such as for the production of ammonia. Electrolysis is a method for producing hydrogen without burning methane, Thus, without dispersing carbon dioxide in the atmosphere. However, to be of any industrial use, the pressure of the hydrogen obtained by electrolysis has to be increased, because hydrogen is a very light molecule. According to one aspect, the present subject matter of the present disclosure is directed to a compressing system or plan which combined different layout of the compressor, namely centrifugal compressors and of integrally geared centrifugal compressors, to achieve a high compression rate of the gas and a reduced footprint of the plant.

Figure 1:
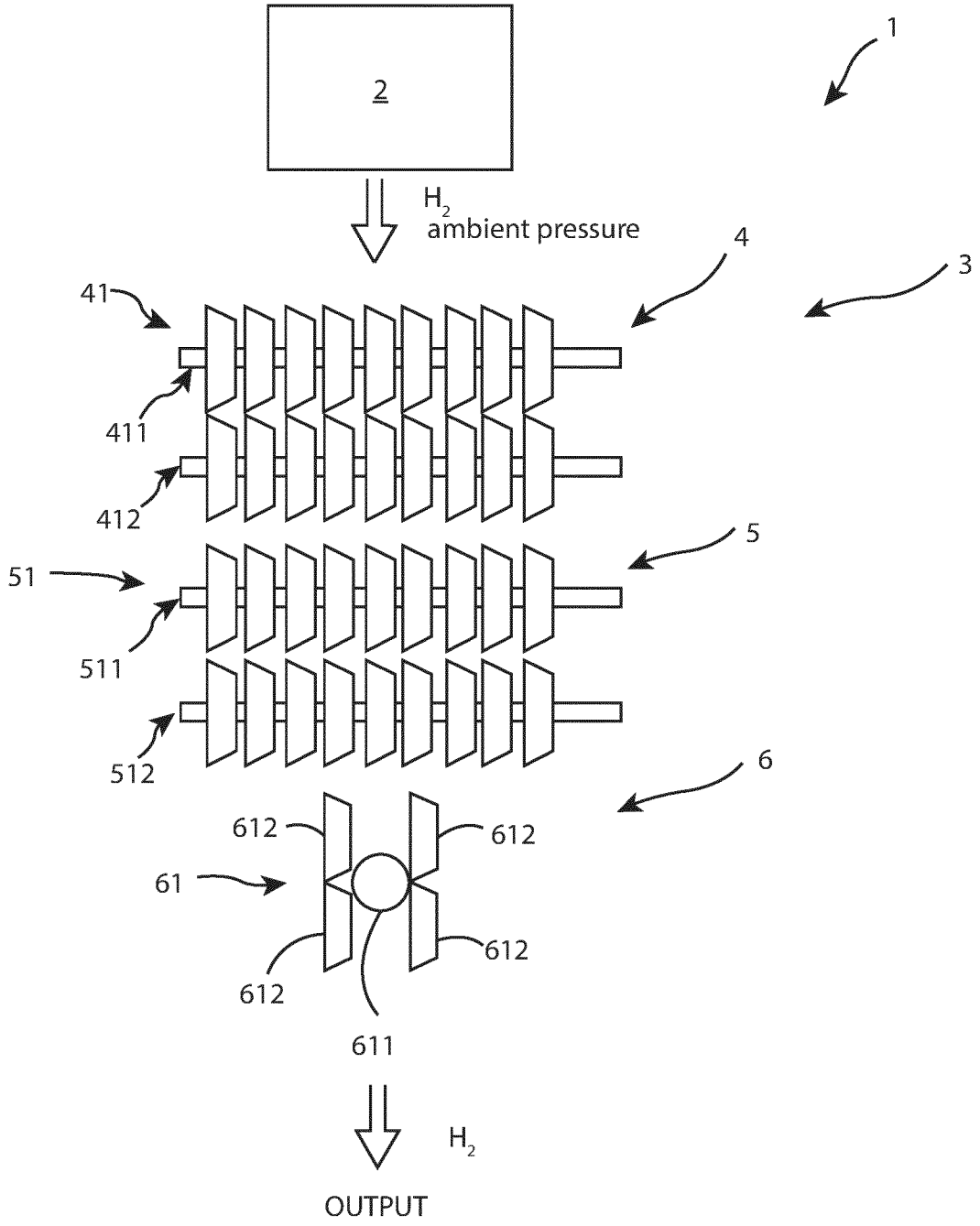
FIG. 1 illustrates a schematic of a plant for producing hydrogen according to a first embodiment.

Referring now to the drawings, FIG. 1 shows a schematic of a hydrogen production plant 1 according to a first embodiment.

In particular, the hydrogen production plant 1 comprises a hydrogen production stage, generally indicated with the numerical reference 2, and a compressing assembly 3, for raising the pressure of the hydrogen up to a pressure of 30-40 bar, as better explained below.

The hydrogen production stage 2 is based on water electrolysis. It is based on the well-known production of hydrogen by splitting water using electricity (electrolysis). This involves passing an electric current through the water to split it into hydrogen and oxygen. The electrolysis offers virtually no pollution or toxic byproducts if the electric current is generated using renewable energy.

The hydrogen produced by the hydrogen production stage 2 is at ambient pressure, so it is challenging to transport in the state in which it is produced. Such hydrogen must be pressurized and stored in special containers suitable for transport or pressurized for transport through a pipeline to a pre-determined destination (storage container, hydrogen turbine, refueling stations, etc.). Therefore, downstream the hydrogen production stage 2 the compressing assembly 3 is connected, to increase the pressure of the produced hydrogen, for it to reach the above-mentioned pressure of 30 bar-40 bar.

More specifically, what has been invented is a new way of pressurizing hydrogen produced by electrolysis in the hydrogen production stage 2 or supplied by any other hydrogen production system, using a unique compressing assembly 3 of the new hydrogen production plant 1. In the embodiment considered, the unique compressing assembly 3 of the new hydrogen production plant 1 is ideally divided into multiple substages. In one example, three substages are used, which include: a lower pressure substage 4, to increase, in the embodiment at issue, the hydrogen pressure from ambient pressure to around 6 bars; an intermediate pressure substage 5, to raise the hydrogen pressure up to around 24 bars; and a final pressure substage 6, to raise the hydrogen pressure up to around 30 bars or more, according to the design requirements of the plant.

More specifically, still referring to the schematic of FIG. 1, the lower pressure substage 4 comprises (schematically) a compression unit 41, having in its turn two barrel compressors 411 and 412 respectively, arranged in series. A barrel compressor is a centrifugal compressor, comprising a shaft, and a set of impellers keyed on the shaft, arranged in series, and a case, having the typical shape of a barrel.

In the schematic embodiment shown, the barrel compressors 411 or 412 comprises nine impellers each. In other embodiments, a different number of impellers for each barrel compressor 411 or 412 of the compression unit 41 can be provided, depending on the desired hydrogen pressure increase, as well as on the flow rate of the hydrogen. In particular, given that for hydrogen a high compression ratio is required, usually the barrel compressors 411 or 412 have no less than three barrel compressors each.

Also, in some embodiments, the barrel compressors 411 or 412 may be driven by variable or fixed speed electric motors (not shown in the figure), so as to better adapt to the gas pressure of the previous centrifugal compressor, as it will be better explained below. More specifically, a variable speed electric motor allows The intermediate pressure substage 5 is structurally analogous to the lower pressure substage 4, comprising a compression unit 51 having two barrel compressors 511 and 512 connected in series.

In this case also, the barrel compressors 511 or 512 have up to ten impellers each, although barrel compressors 511 or 512 with a different number of impellers can be installed, depending on the pressure compression ratio.

The barrel compressors 511 or 512 of the intermediate pressure substage 5 may be driven by variable or fixed speed electric motors (not shown in the figure), so as to better adapt to the gas pressure of the previous centrifugal compressor, as better explained below.

The lower pressure substage 4 and the intermediate pressure substage 5 may comprise more than one compressing unit 41 or 51 respectively, depending on the flow rate of the hydrogen to be compressed.

The final pressure substage 6 increases the temperature of the hydrogen up to the desired pressure. The final pressure substage 6 comprises a compressing unit 61 of intercooled integrally geared centrifugal compressor type, comprising, in the case at issue, four impellers 612, of course, mechanically driven by a central bull gear 611. The implementation of this layout has advantages in terms of high-speed 3D impellers, relatively low costs (if compared to conventional compressors), and higher efficiencies. It also turns out to be particularly small in terms of footprint, always if compared with conventional compressors.

The hydrogen output of the final pressure substage 6 has the requested pressure without the wet part so that the gas can be immediately installed.

Figure 2:
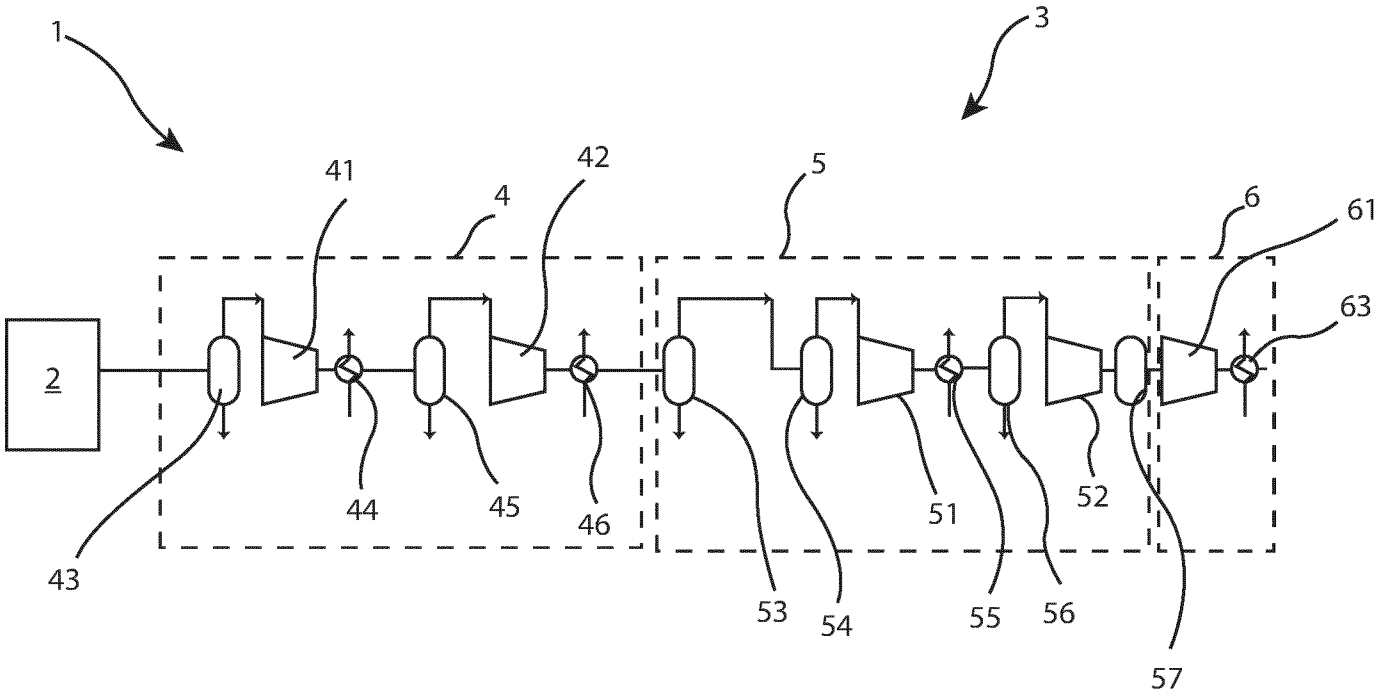
FIG. 2 illustrates a layout of a plant for producing hydrogen according to a second embodiment.

Referring now to FIG. 2, a more specific design of a layout of the hydrogen production plant 1 according to a second embodiment is illustrated, which is structurally and functionally analogous to the first embodiment.

More specifically, the hydrogen production plant 1 of FIG. 1 comprises the hydrogen production stage 2, whereby ambient pressure hydrogen is produced by water electrolysis, and the compressing assembly 3.

The hydrogen production stage 2 operates by electrolysis, likewise the first embodiment.

The compressing assembly 3 comprises, also in this case, a lower pressure substage 4, an intermediate pressure substage 5, and a final pressure substage 6. The lower pressure substage 4 comprises a first condenser 43, connected to the hydrogen production stage 2, for condensing part of the wet component of the hydrogen coming from the electrolizers of the hydrogen production stage 2.

Figure 3:
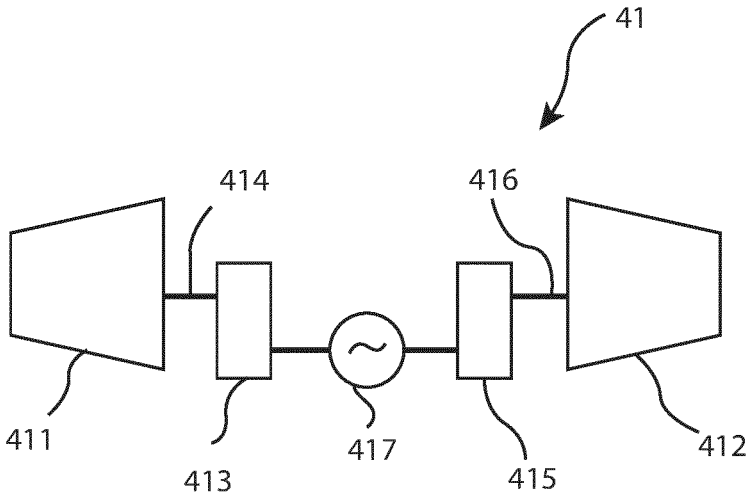
FIG. 3 illustrates a barrel compressor stage for increasing the pressure of the hydrogen of the plant of FIG. 2.

The lower pressure substage 4 also comprises a first compression unit 41, connected downstream to the first condenser 43. Referring to FIG. 3, the layout of the first compression unit 41 of the lower pressure substage 4 is illustrated. The first compression unit 41 comprises a first barrel compressor 411, a first gearbox 413, connected to the drive shaft 414 of the first barrel compressor 411, a second barrel compressor 412, a second gearbox 415, connected to the drive shaft 416 of the second barrel compressor 412, and a drive electric motor 417, operatively connected to the first gearbox 413 and the second gearbox 415, to operate the barrel compressors 411 and 412. The gear ratio of each gearbox 413 and 415 is set according to the compression performances required.

Also, any kind of gearbox can be implemented, such as the epicyclic or planetary gearboxes, worm gearboxes, helical gearboxes, bevel gearboxes.

Suitable gearbox rations can be determined depending on the compression ratio is desired. Also, the overall compression ratio of the compressing assembly 3 is distributed through each compressing stage according to specific design necessities can be.

In the drive electric motor 417 is a variable speed electric motor, so as to better adapt the compression ratio of the lower pressure substage 4, depending on the inlet gas flow rate.

In other embodiments, the drive electric motor 417 can have a fixed speed, thus saving the overall costs of the system.

Also, the first barrel compressor 411 may be equipped with Inlet Guide Vanes—IGVs (not shown in the figure), to adjust the airflow and pressure that enters the centrifugal compressor.

The lower pressure substage 4 comprises also a first heat exchanger, which can be of any kind, 44, to lower the temperature by intercooling of the hydrogen and possibly condense the wet of the same, a second condenser 45, connected downstream the first heat exchanger 44, and a second compression unit 42, connected to the second condenser 45. The second compression unit 42 in the present embodiment is equal to the first compression unit 41.

Finally, the lower pressure substage 4 comprises a second heat exchanger 46, connected to the second compression unit 42. The intermediate pressure substage 5 comprises a third 53 and a fourth 54 condenser, series connected to the second heat exchanger 44 of the lower pressure substage 4, to reduce the moisture of the hydrogen gas.

Also, the intermediate pressure substage 5 comprises a first compression unit 51, similar from the structural and functional standpoint to the compression unit 41 of the lower pressure substage 4.

The intermediate pressure substage 5 comprises a heat exchanger 55, connected to the first compression unit 51, a fifth condenser 56, connected to the heat exchanger 55, second compression unit 52, connected to the fifth condenser 56, similar from the structural and functional standpoint to the first compression unit 51, and a sixth condenser 57.

Figure 4:
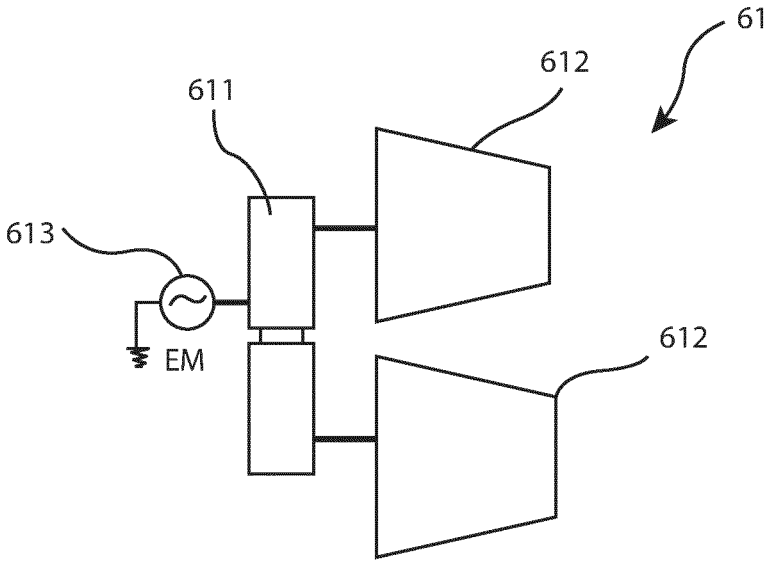
FIG. 4 illustrates an integrally geared centrifugal compressor stage for increasing the pressure of the hydrogen of the plant of FIG. 2.

The final pressure substage 6 comprises a compressing unit 61, connected to the sixth condenser 57, and a heat exchanger 63 to lower the temperature of the hydrogen and condensate its wet. The compressing unit 61 is, as mentioned above, of the integrally geared centrifugal compressor type, as it is illustrated in FIG. 4. The compressing unit 61 of the final pressure substage 6 comprises bull gear 611, two impellers 612, mechanically connected to the bull gear 611, and an electric drive electric motor 613 operatively connected to the bull gear 611, to operate the impellers 612, which compress the hydrogen acting in series.

This layout is particularly useful to increase the pressure of the hydrogen since it has reduced sizes and it does not require water condensation for reducing the temperature of the compressed gas.

In some embodiments, the number of impellers 612 can be different, depending on the flow rate and the performances required.

The green hydrogen production plant 1 operates as follows.

When the hydrogen production stage 2 generates the hydrogen electrolysis, the gas is at ambient temperature and wet. The hydrogen then enters into the first condenser 43 of the lower pressure substage 4, to reduce its moisture, to be then compressed by the first compressing unit 41, by means of the first borrow compressor 411 and the second borrow compressor 412, properly driven by the electric monitor 417 and the gearboxes 413 and 415.

Then, the compressed gas is cooled down by the first heat exchanger 44 and processed by the condenser 45, before being further compressed by the second compressing unit 42, which, as said, is structurally and functionally similar to the first compressing unit 41. Then, the further compressed gas passes through the second heat exchanger for the six before reaching the third and the fourth condensers 53 and 54 of the intermediate pressure substage 5, to be further compressed by the first compressing unit 51. Then the gas passes through the heat exchanger 55 and the fifth condenser 56, before being compressed by the second compressing unit 52.

Finally, the gas passes through the condenser 57, before leaving the intermediate pressure substage 5, reducing again its wet.

The hydrogen enters into the final pressure substage 6, and in particular, it is compressed by the compressing unit 61, which, as said above, is of the integrally geared centrifugal compressor type, equipped with two impellers 612, driven by the bull gear 611, in its turn driving by the electric matter 613. The integrally geared centrifugal compressing unit 61 between each impeller has intercooler stages, capable of lower the temperature of the gas.

Before leaving the hydrogen production plant 1, the compressed gas, which has now pressure around 30-40 bar, passes through the heat exchanger 63, so as to further reduce the final monster of the hydrogen.

At this point, the high-pressure hydrogen is ready to be transported and possibly to produce ammonia or for any other use.

Figure 5:
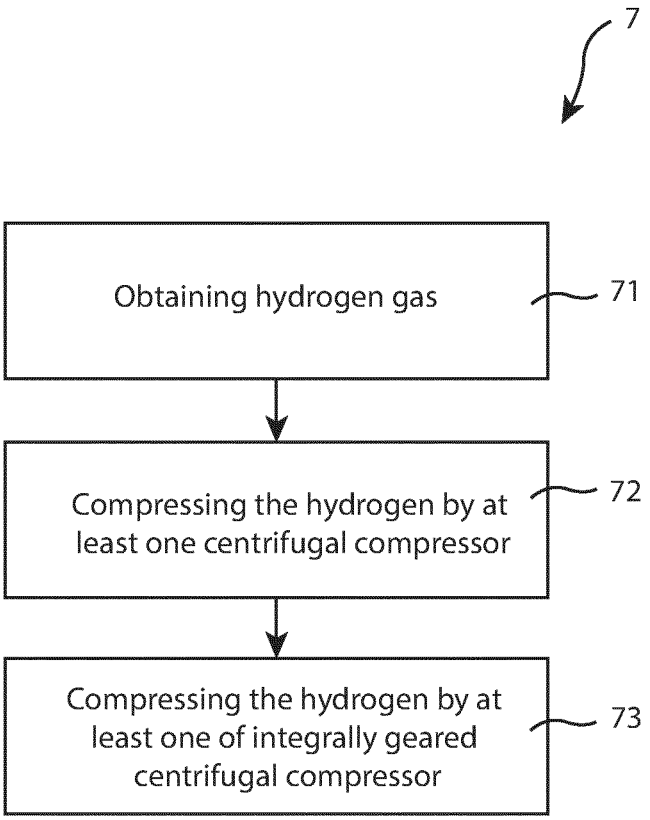
FIG. 5 illustrates a flow chart of methods of compressing hydrogen gas according to the present disclosure.

Referring to FIG. 5, a method 7 of compressing hydrogen gas is shown, which is carried out by the hydrogen production plant 1. The method 7 comprises the steps of obtaining 71 hydrogen gas, which, in order to produce high-pressure green hydrogen, it is carried out by electrolysis, by the hydrogen production stage 2.

Then the method 7 comprises the step of compressing 72 hydrogen by at least one centrifugal compressor, such as compressing units 41, 42, 51, 52, which comprise barrel compressors 411, 412, etc.

Finally, the method 7 of compressing hydrogen gas further comprises the step of compressing 73 the hydrogen by at least one of integrally geared centrifugal compressor 61.

An advantage of the solution disclose is that it is possible to increase the availability and reliability of the hydrogen production plants.

Another advantage is that the hydrogen production plant realized with this layout has a reduced footprint if compared with the hydrogen production plants of the prior art.

An additional advantage of the compression layout according to the present disclosure is that the application of the integrally geared centrifugal compressor in the final pressure substage fits well with this train because of the low volumetric flow at the end of the compression process.

A further advantage of the present disclosure is that it provides a compact solution for $H_2$ compression with respect to the standard solution with a reciprocating compressor. Moreover, the mean time between maintenance (MTBM) is drastically reduced, so as to achieved reduced operating expenditures (OPEX).

While aspects of the invention have been described in terms of various specific embodiments, it will be apparent to those of ordinary skill in the art that many modifications, changes, and omissions are possible without departing form the spirt and scope of the claims. In addition, unless specified otherwise herein, the order or sequence of any process or method steps may be varied or re-sequenced according to alternative embodiments.

Reference has been made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

When elements of various embodiments are introduced, the articles "a", "an", "the", and "said" are intended to mean that there are one or more of the elements. The terms "comprising", "including", and "having" are intended to be inclusive and mean that there may be additional elements other than the listed elements.

The invention claimed is:

1. A gas compressing assembly for compressing a gas, comprising:

a low pressure stage having a first barrel compressor and a second barrel compressor, the low pressure stage further comprising:

a first condenser connected upstream of the first barrel compressor;

a first heat exchanger downstream of the first barrel compressor to lower the temperature by intercooling, and, eventually, condensing a wet part of the gas;

a second condenser connected downstream of the first heat exchanger and interposed between the first heat exchanger and the second barrel compressor; and a second heat exchanger connected downstream of the second barrel compressor;

an intermediate pressure stage downstream of the low pressure stage, the intermediate stage comprising a third barrel compressor and a fourth barrel compressor; and a final pressure stage downstream of the intermediate stage, the final pressure stage comprising an integrally-geared centrifugal compressor;

a third condenser and a fourth condenser series-connected downstream of the second heat exchanger, wherein the third condenser and the fourth condenser are capable of reducing the wet part of the gas;

a third heat exchanger connected downstream of the third barrel compressor;

a fifth condenser connected between the third heat exchanger and the fourth barrel compressor; and a sixth condenser connected downstream the fourth barrel compressor.

2. The gas compressing assembly of claim 1, further comprising:

a drive electric motor, wherein the first barrel compressor comprises a first drive shaft and a first gearbox connected to the drive shaft of the first barrel compressor, wherein the second barrel compressor comprises a second drive shaft and a second gearbox connected to the drive shaft of the second barrel compressor, and wherein the drive electric motor is operatively connected to the first gearbox and the second gearbox to operate the first barrel compressor and the second barrel compressor.

3. The gas compressing assembly of claim 2, wherein the drive electric motor comprises either a variable speed electric motor or a fixed speed electric motor.

4. The gas compressing assembly of claim 1, wherein the final pressure stage comprises:

a bull gear;

two or more impellers mechanically connected to the bull gear; and an electric drive electric motor operatively connected in series to the bull gear to operate the impellers to compress the gas.

5. A gas compressing assembly for compressing a gas, comprising:

a low pressure stage having a first barrel compressor and a second barrel compressor, the low pressure stage further comprising:

a first condenser connected upstream of the first barrel compressor;

a first heat exchanger downstream of the first barrel compressor to lower the temperature by intercooling, and, eventually, condensing a wet part of the gas;

a second condenser connected downstream of the first heat exchanger and interposed between the first heat exchanger and the second barrel compressor; and a second heat exchanger connected downstream of the second barrel compressor;

an intermediate pressure stage downstream of the low pressure stage, the intermediate stage comprising a third barrel compressor and a fourth barrel compressor;

a final pressure stage downstream of the intermediate stage, the final pressure stage comprising an integrally-geared centrifugal compressor, the final pressure stage further comprising a heat exchanger connected downstream of the integrally-geared centrifugal compressor to lower the temperature of the gas and condensate the wet part of the gas;

a third condenser and a fourth condensers series-connected downstream of the second heat exchanger, wherein the third condenser and the fourth condenser are capable of reducing wet of the gas;

a third heat exchanger connected downstream of the third barrel compressor;

a fifth condenser connected between the third heat exchanger and the fourth barrel compressor; and a sixth condenser connected downstream the fourth barrel compressor.

6. The gas compressing assembly of claim 5, further comprising:

a drive electric motor, wherein the first barrel compressor comprises a first drive shaft and a first gearbox connected to the drive shaft of the first barrel compressor, wherein the second barrel compressor comprises a second drive shaft and a second gearbox connected to the drive shaft of the second barrel compressor, and wherein the drive electric motor is operatively connected to the first gearbox and the second gearbox to operate the first barrel compressor and the second barrel compressor.

7. The gas compressing assembly of claim 6, wherein the drive electric motor comprises either a variable speed electric motor or a fixed speed electric motor.

8. The gas compressing assembly of claim 5, wherein the final pressure stage comprises:

a bull gear;

two or more impellers mechanically connected to the bull gear; and an electric drive electric motor operatively connected in series to the bull gear to operate the impellers to compress the gas.

* * * * *